US006257634B1

(12) United States Patent
Wei

(10) Patent No.: US 6,257,634 B1
(45) Date of Patent: Jul. 10, 2001

(54) MANUAL LITTER PICKER

(76) Inventor: Ming-Ching Wei, P.O. Box 453, Taichung (TW)

( * ) Notice: Subject to any disclaimer, the term of this patent is extended or adjusted under 35 U.S.C. 154(b) by 0 days.

(21) Appl. No.: 09/659,421

(22) Filed: Sep. 11, 2000

(51) Int. Cl.[7] ..... B25J 1/02
(52) U.S. Cl. ..... 294/19.1
(58) Field of Search ..... 294/19.1, 19.2, 294/22, 23, 50.8, 50.9, 115, 116, 1.4; 51/328.1, 332, 333, 335

(56) References Cited

U.S. PATENT DOCUMENTS 2,616,741 * 11/1952 Ziese ..... 294/19.1
4,039,216 * 8/1977 Soos ..... 294/19.1
4,374,600 * 2/1983 van Zelm ..... 294/19.1
4,647,094 * 3/1987 Bergkvist et al. ..... 294/19.1 X
4,669,769 * 6/1987 Polder ..... 294/19.1
5,192,104 * 3/1993 Lin ..... 294/19.1

* cited by examiner

*Primary Examiner*—Johnny D. Cherry

(57) ABSTRACT

A litter picker comprises a pistol grip, an extension rod, a fixed tube, a movable tube, two claws, two link members, and a pull cord. The pistol grip has a trigger lever for actuating the pull cord so as to cause the movable tube to slide toward the fixed tube, thereby causing the claws to move toward each other to hold the litter. As the trigger lever is let go, the movable tube is forced by a recovery spring to move back to its original position, thereby enabling the two claws to move away from each other to release the litter.

6 Claims, 5 Drawing Sheets

MANUAL LITTER PICKER

BACKGROUND OF THE INVENTION

1. Field of the Invention

The present invention relates generally to a litter picker, and more particularly to a manually-operated litter picker.

2. Description of Related Art

The conventional litter picker comprises two elastic clamps for picking up bits or scraps of rubbish scattered about on the ground; it is a handy tool to get rid of the litter on the ground. However, the conventional litter picker is prone to put a strain on the hand of a user.

BRIEF SUMMARY OF THE INVENTION

The primary objective of the present invention is to provide a manually-operated litter picker which is easy to use, without being burdensome to its user.

In keeping with the principle of the present invention, the foregoing objective of the present invention is attained by the litter picker comprising a pistol grip, an extension rod, a fixed tube, a movable tube, two claws, two link members, and a pull cord. The movable tube is actuated by the pull cord to slide in the direction toward the fixed tube, thereby causing the two claws to swivel toward each other to bring about the holding action by which the litter is picked up.

The features and the advantages of the present invention will be more readily understood upon a thoughtful deliberation of the following detailed description of the present invention with reference to the accompanying drawings.

BRIEF DESCRIPTION OF THE SEVERAL VIEWS OF THE DRAWINGS

FIG. 3-1 shows a schematic view of a trigger lever of the preferred embodiment of the present invention in action.

FIG. 4-1 shows a schematic view of the claws of the preferred embodiment of the present invention in action.

FIG. 4-2 shows another schematic view of the claws of the preferred embodiment of the present invention.

DETAILED DESCRIPTION OF THE INVENTION

Figure 1:
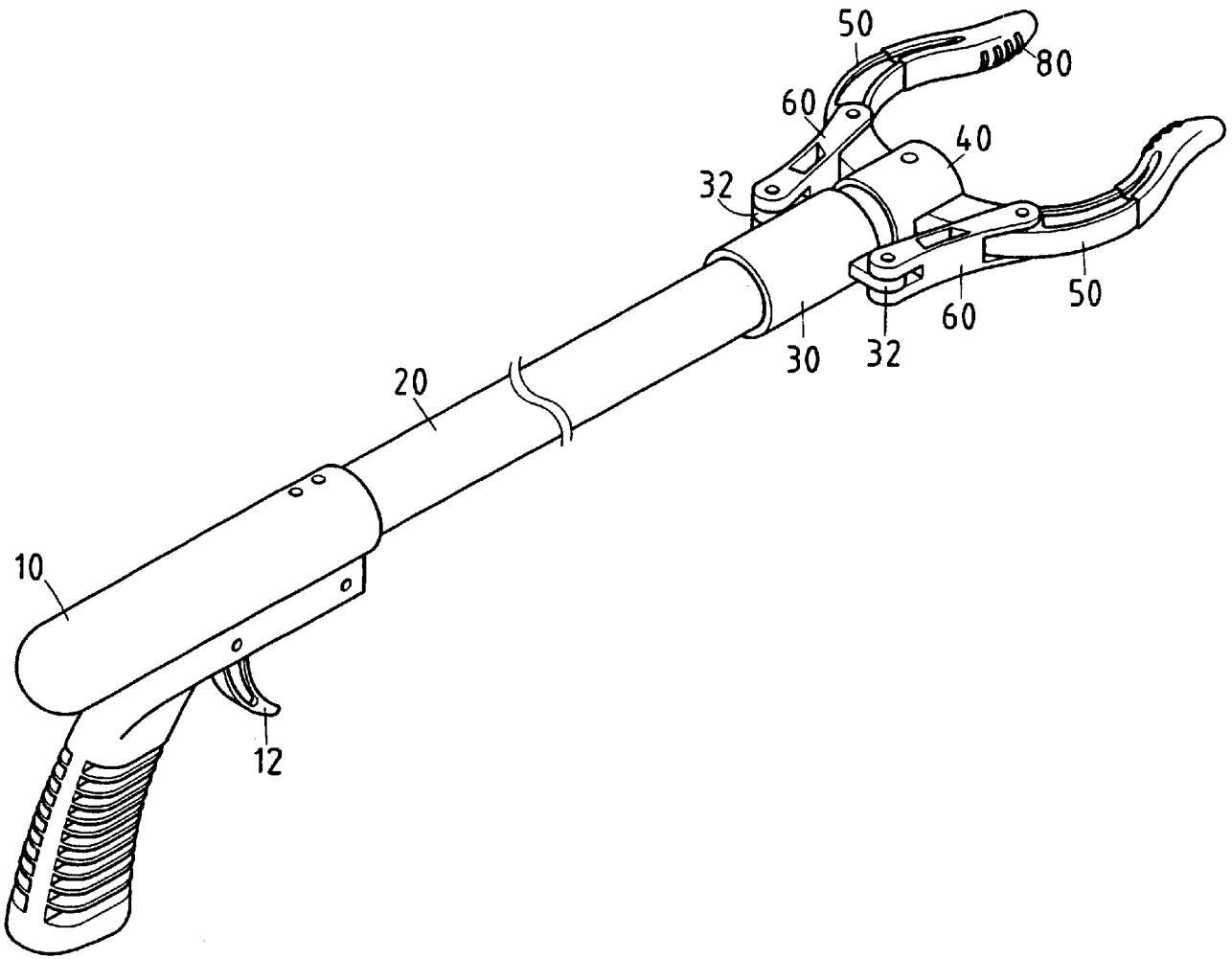
FIG. 1 shows a perspective view of a preferred embodiment of the present invention.
Figure 2:
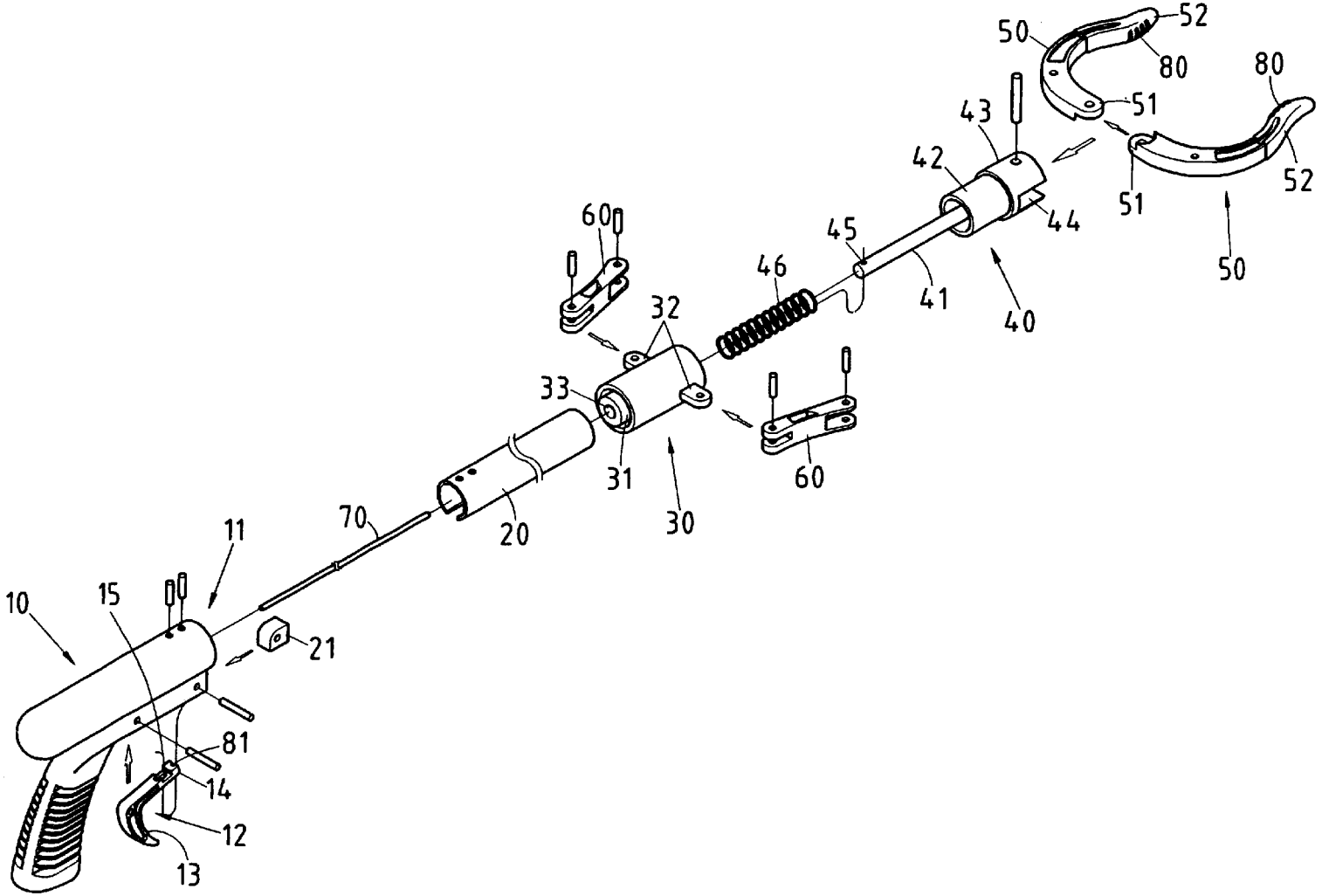
FIG. 2 shows an exploded view of the preferred embodiment of the present invention.
Figure 3:
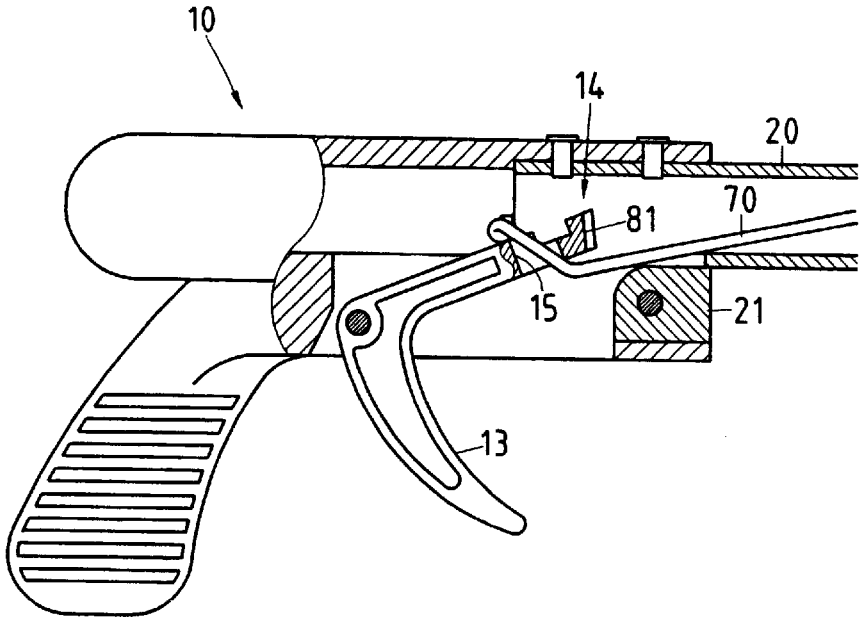
FIG. 3 shows a partial sectional view of the preferred embodiment of the present invention in combination.
Figures 1, 3:
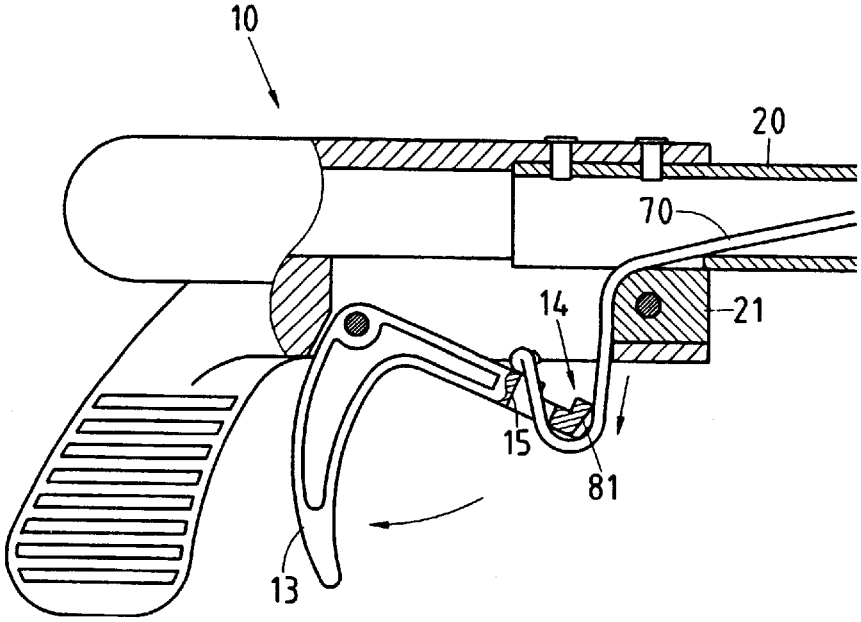
Figure 4:
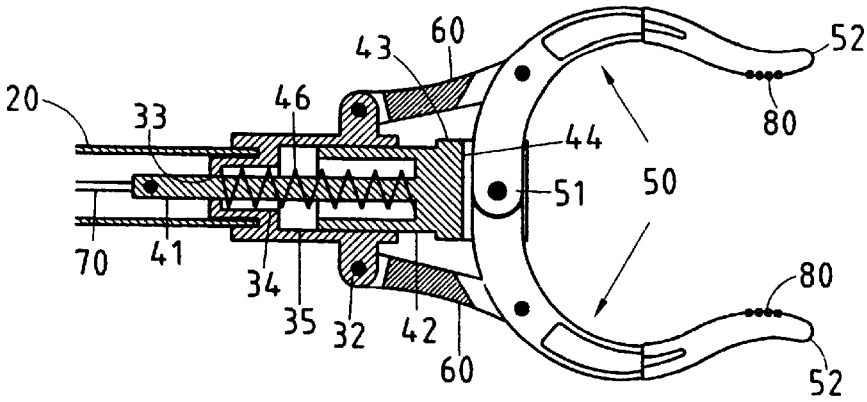
FIG. 4 shows another partial sectional view of the preferred embodiment of the present invention in combination.
Figures 1, 4:
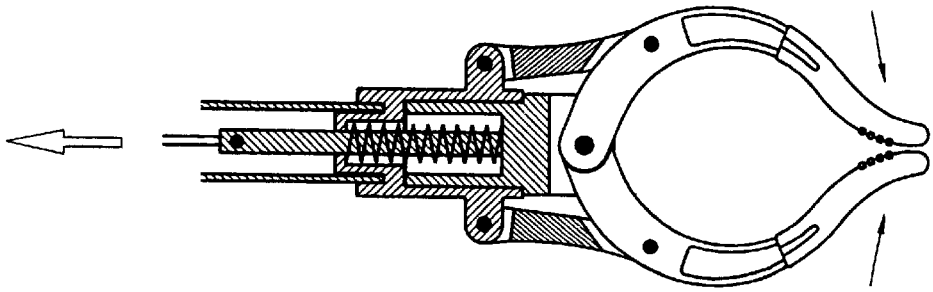
Figures 2, 4:
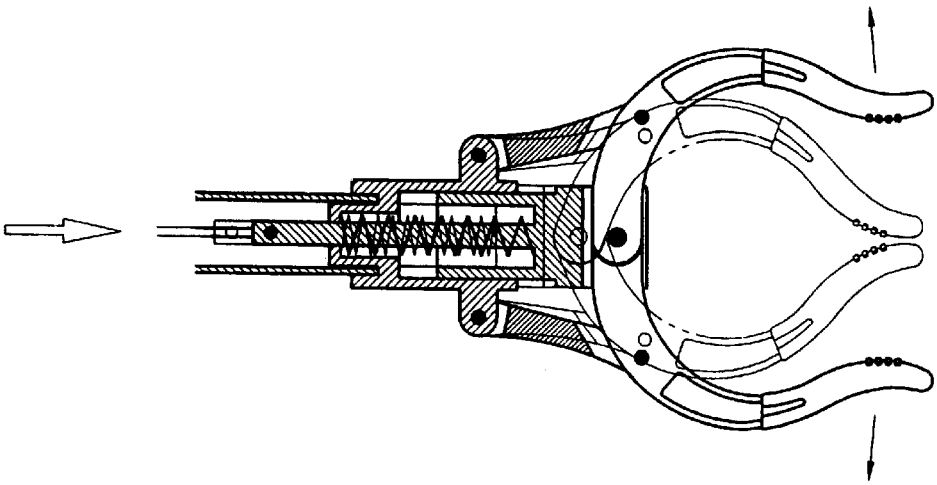

As shown in FIGS. 1–4, a litter picker of the present invention comprises a grip 10, an extension rod 20, a fixed tube 30, a movable tube 40, two claws 50, two link members 60, and a pull cord 70.

The grip 10 is shaped like a pistol and is provided with a receiving hole 11 and a trigger member 12. The trigger member 12 is formed of a trigger lever 13 and a swivel end 14 having a cord hole 15.

The extension rod 20 of a hollow construction is fitted at one end thereof into the receiving hole 11 of the grip 10.

The fixed tube 30 is provided at one end with an annular projection 31 which is fitted into other end of the extension rod 20. The fixed tube 30 is provided in the outer wall with two lugs 32 opposite to each other, and in the interior with an axial hole 33, a core slot 34, and a seat hole 35.

The movable tube 40 is formed of a shaft rod 41, a waist tube 42, and a head tube 43. The head tube 43 is provided with a slot 44. The shaft rod 41 is provided at a front end with a through hole 45. The shaft rod 45 is first fitted into a recovery spring 46 before the movable tube 40 is pivoted in the fixed tube 30 such that the front end of the shaft rod 41 is jutted out of the axial hole 33 of the fixed tube 30. The waist tube 42 is pivoted in the seat hole 35. One end of the recovery spring 46 urges the inner edge of the core slot 34, whereas the other end of the recovery spring 46 urges a front end edge of the waist tube 42.

The two claws 50 have a fixed end 51 and a movable end 52. The fixed ends 51 of the two claws 50 are alternatingly pivoted in the slot 44 of the movable tube 40 such that the movable ends 52 turn on the fixed ends 51 serving as pivots.

The two link members 60 are joined with the fixed tube 30 and the movable tube 40 such that the front ends of the two link members 60 are pivoted with the lugs 32 of the fixed tube 30, and that the rear ends of the two link members 60 are pivoted with the two claws 50.

The pull cord 70 is fixed at one end thereof in the cord hole 15 of the swivel end 14 of the trigger member 12, and at the other end thereof in the through hole 45 of the front end of the shaft rod 41 of the movable tube 40.

The movable ends 52 of the two claws 50 are provided in an inner side thereof with a plurality of skidproof knobs 80 to enhance the holding effect of the movable ends 52.

The cord hole 15 of the swivel end 14 of the trigger member 12 of the grip 10 has a keyhole shape.

The swivel end 14 of the trigger member 12 of the grip 10 is provided with a cord-guiding groove 81.

The extension rod 20 is provided at one end thereof with a locating member 21 which is located between the swivel end 14 of the trigger member 12 and the receiving hole 11 of the grip 10 for locating the one end of the extension rod 20.

Figure 5:
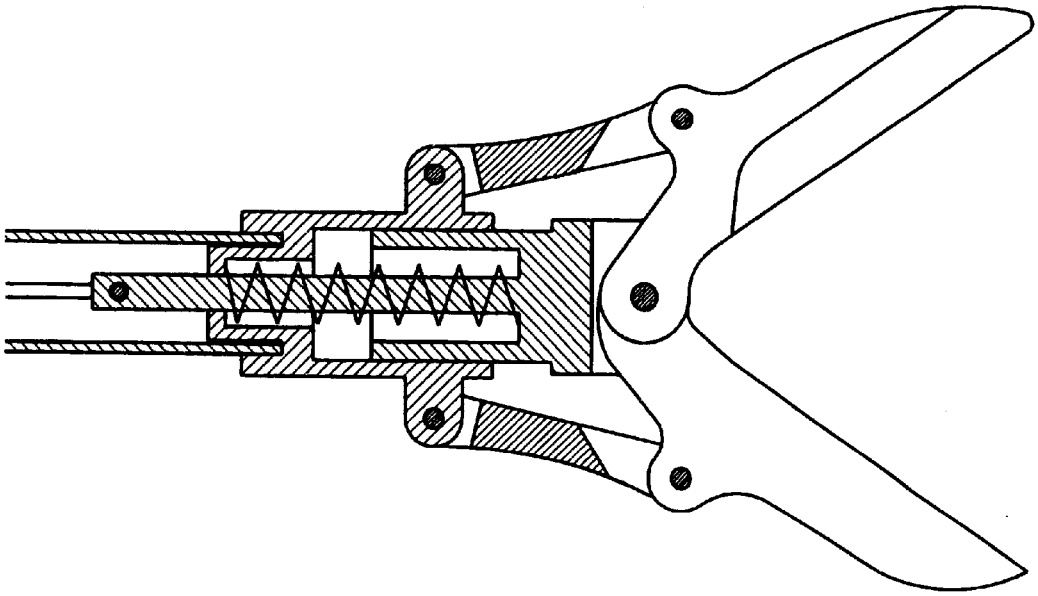
FIG. 5 shows a schematic view of another preferred embodiment of the present invention.

As shown in FIG. 5, the two claws 50 of the present invention are provided with a blade capable of cutting the litter into pieces.

In use, the pull cord 70 is actuated by the trigger lever 13 to cause the movable tube 40 to slide toward the fixed tube 30, thereby causing the two claws 50 to move toward each other to hold the litter. As the trigger lever 13 is let go, the movable tube 40 is forced by the spring force of the recovery spring 46 to move back to its original position. In light of the two claws 50 being refrained by the link members 60, the two claws 50 move away from each other to release the litter.

The action of the litter picker of the present invention is easily effected with a finger by which the trigger lever 13 is activated and deactivated.

I claim:

1. A litter picker comprising:

a grip provided with a receiving hole, and a trigger member which is formed of a trigger lever and a swivel end having a cord hole;

an extension rod of a hollow construction and fitted at one end thereof into said receiving hole of said grip;

a fixed tube provided at one end with an annular projection which is fitted into the other end of said extension rod, said fixed tube further provided in an outer wall with two lugs opposite to each other, and in an interior with an axial hole, a core slot, and a seat hole;

a movable tube formed of a shaft rod, a waist tube, and a head tube which is provided with a slot, said shaft rod being provided at one end with a through hole and fitted into a recovery spring whereby said movable tube is pivoted in said fixed tube such that said one end of said shaft rod is jutted out of said axial hole of said fixed tube, and that said waist tube is pivoted in said seat hole of said fixed tube, and further that one end of said recovery spring urges an inner edge of said core slot, with the other end of said recovery spring urging said waist tube;

two claws, with each having a fixed end and a movable end, said fixed end being pivoted in said slot of said movable tube such that said movable end turns on said fixed end acting as a pivot;

two link members fastened with said fixed tube and said movable tube such that said link members are pivoted at one end with said lugs of said fixed tube, and that said link members are pivoted at the other end with said claws; and a pull rod fixed at one end in said cord hole of said swivel end of said trigger member, and at the other end in said through hole of said shaft rod of said movable tube, said pull cord being actuated by said trigger member to cause said movable tube to slide in the direction toward said fixed tube, thereby causing said claws to move toward each other, whereby said movable tube is forced by said recovery spring to move back to an original position of said movable tube at such time when said trigger member is relieved of an external force exerting thereon, thereby causing said two claws to move away from each other.

2. The litter picker as defined in claim 1, wherein said two movable ends of said two claws are provided in an inner side with a plurality of skidproof knobs.

3. The litter picker as defined in claim 1, wherein said core hole of said swivel end of said trigger member has a keyhole shape.

4. The litter picker as defined in claim 1, wherein said swivel end of said trigger member is provided with a cord-guiding groove.

5. The litter picker as defined in claim, wherein said extension rod is provided at one end with a locating member which is located between said swivel end of said trigger member and said receiving hole of said grip for locating said one end of said extension rod.

6. The litter picker as defined in claim 1, wherein said two claws are provided with a blade capable of cutting an object into pieces.

* * * * *